US005779306A

United States Patent [19]

Ohlsson

[11] Patent Number: 5,779,306

[45] Date of Patent: Jul. 14, 1998

[54] MODULAR CHAIR CONSTRUCTION

[76] Inventor: Åke Ohlsson, Floravägen 21 D, S-137, 38 Västerhaninge, Sweden

[21] Appl. No.: 732,227

[22] PCT Filed: Apr. 27, 1995

[86] PCT No.: PCT/SE95/00470

§ 371 Date: Nov. 21, 1996

§ 102(e) Date: Nov. 21, 1996

[87] PCT Pub. No.: WO95/28865

PCT Pub. Date: Nov. 2, 1995

[30] Foreign Application Priority Data

Apr. 27, 1994 [SE] Sweden ..... 9401447
Sep. 9, 1994 [SE] Sweden ..... 9403017

[51] Int. Cl.[6] ..... A47C 1/08

[52] U.S. Cl. ..... 297/256.16; 297/256.15; 297/182; 297/423.41; 297/188.09

[58] Field of Search ..... 297/256.16, 250.1, 297/256.15, 252, 440.14, 182, 188.08, 423.39, 423.4, 423.41, 423.44, 440.1, 440.22, 256.1, 118, 130, 105, 188.09, 188.12, 188.13, 188.2; 4/239

[56] References Cited

U.S. PATENT DOCUMENTS 902,449 10/1908 Price ..... 4/239 X
1,089,040 3/1914 Block ..... 297/250.1 X
1,358,933 11/1920 Collins .
1,739,366 12/1929 Lang ..... 4/239 X
2,245,204 6/1941 Plante .
2,530,474 11/1950 Lutes .
2,767,408 10/1956 Reibman ..... 4/239
2,940,086 6/1960 Wondrack ..... 4/239
2,955,296 10/1960 Zapolski ..... 297/250.1 X
3,142,847 8/1964 Kurrels .
3,371,356 3/1968 Benjamin ..... 4/239
4,381,568 5/1983 Brown ..... 4/239

FOREIGN PATENT DOCUMENTS 1252885 2/1960 France .
182001 4/1935 Switzerland .

*Primary Examiner*—Milton Nelson, Jr.
*Attorney, Agent, or Firm*—Burns, Doane, Swecker & Mathis, L.L.P.

[57] ABSTRACT

A modularly constructed child's chair includes a chair module which is equipped with a back rest, a side rest, and a seat. The chair module is equipped with a seat hole and with a chair fastening device for fastening the chair module on either the upper part of a base unit or the upper part of a toilet. A removable seat hole cover, which covers the seat hole, includes a cover fastening device for fastening the cover on either the chair module, or on a base unit. A base unit which fits the chair module includes receivers for the cover fastening device and for the chair fastening device. In addition to other accessory modules, a support module, serving as a front and crotch support, along with a potty module, are part of the modularly constructed child's chair.

6 Claims, 9 Drawing Sheets

MODULAR CHAIR CONSTRUCTION

The present invention concerns a modularly constructed child's chair of the type which is described in claim 1.

BACKGROUND OF THE INVENTION

There is a requirement for a modularly constructed child's chair which through different combinations of modules can be adapted to a number of different areas of application. It is above all the requirement for the combination of a potty chair and a seat, with or without a support module, which is the reason for the invention being made, but also the requirement to be able, after adaptation of the combination of modules, to use the chair as a toilet seat suitable for children.

A modularly constructed chair construction is known from U.S. Pat. No. 2,530,474. This known chair construction can, through a combination of different accessory units, inter alia be adapted for use as low child's chair, potty chair or child's high chair, whereby a seat and backrest unit can be fastened on a low support unit, which at the same time can serve as a potty holder, or on a specially adapted high kitchen stool or kitchen chair without a backrest. The different units are attached to each other by means of a fasting means, composed of pins and belts equipped with slits, arranged on a seat and backrest unit, which, during fastening together with an accessory unit, are received in pin cut-outs, respectively fastened over bosses, arranged on the accessory unit.

FR-A- 1 252 685 shows a toilet chair with a backrest, for children, where the seat is provided with a seat hole and fastening means for attaching the seat to a normal toilet. The seat is also equipped with a belt for fastening a child to the seat. The fastening means consist of adjustable opposing bosses for support against the front part of the toilet and a resilient rear fastening means for resilient fastening of the seat against the rear part of the toilet.

OBJECTS AND ADVANTAGES OF THE PRESENT INVENTION

It is an object of the present invention to obtain a flexibly usable and adaptable child chair which permits different assembly combinations between the modules comprised in the invention as well as with existing chairs and toilets. It is especially desired to be easily able to convert the child's chair for use, and secure anchoring, on a normal toilet. Another object is to obtain a modularly constructed child's chair, of which the modules in a simple and secure manner permit fastening together of modules with each other or with existing chairs and toilets. An additional object of the child's chair according to the invention is as needed to be able to use it as a normal child's chair, also called "play chair", and to moreover simply and securely be able to anchor it on a conventional chair to form a high child's chair. Yet an additional object is to provide an easily removable and mountable support module serving as a front support and crotch support. Yet another object with the invention is to provide a demountable modularised chair, which in its separate parts can easily be stowed in, for example, a car. Another object is to provide a child's chair with chair modules equipped with locking devices and fastening means which allow simple assembly together of modules and existing chairs, and which promote good hygiene as well as having industrial engineering advantages.

An advantage with the present invention that it furnishes a potty and child's chair which can be adapted in accordance with a growing child's needs. For example during the transition from potty to toilet, the toilet can be adapted so that the child feels safe in the firmly anchored chair.

The above and other objects and advantages are achieved according to the invention through a modularly constructed child's chair, which has the characteristics which are described in the characterising part of claim 1. Different developments and embodiments of the invention are disclosed in the subclaims.

DESCRIPTION OF THE DRAWINGS

The invention shall be explained in more detail with the following drawings, which shows non-limiting examples of embodiments of the invention.

DESCRIPTION OF THE INVENTION

Figure 1:
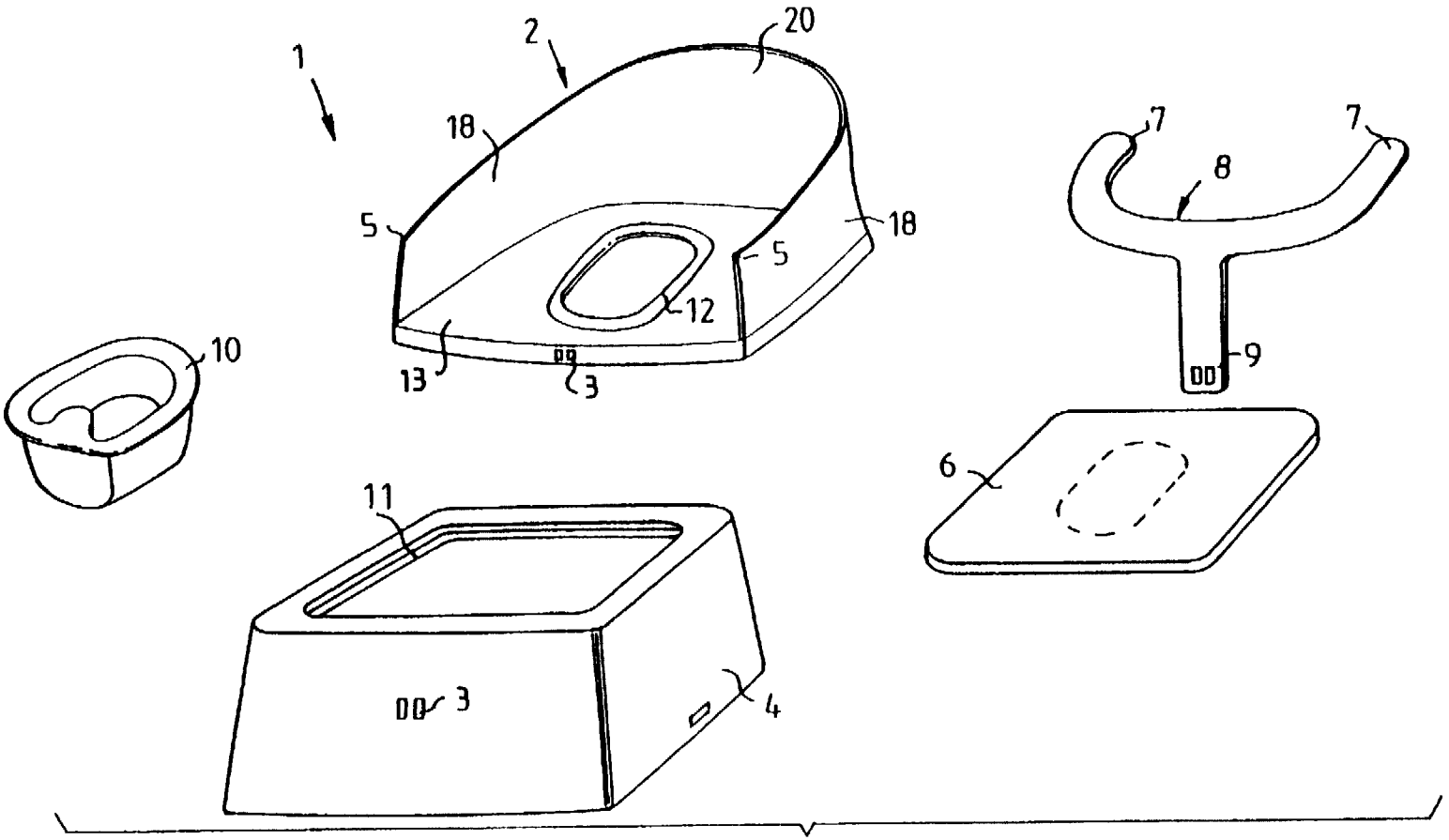
FIG. 1 shows, in perspective, an overview of different modules in an embodiment of the child's chair according to the invention.

FIG. 1 shows an overview of the different base modules in a potty and child's chair according to the invention.

whereby the child's chair in general is represented by 1. An embodiment of the invention comprises a chair module 2 with a void for a seat hole 12, a base module, adapted for the chair, in the shape of a base unit 4 with a void 11, a removable seat hole cover 6 which covers seat hole 12 and base unit void 11 and serves as a seating and standing surface, a support module 8 for front and crotch support fastenable onto chair module 2 and possibly onto base unit 4, as well as a potty 10 of already known type. An anchoring organ, not shown, can also belong to the child's chair, for example an anchoring belt and a fastening belt, for anchoring the child's chair onto a conventional chair. The chair module 2 has further a backrest 20, a side rest 18, attachment points 5, and possibly 3, for the support module 8 as well as a seat, and is equipped with a seat hole 12 into which the potty 10 can placed. The chair module includes chair attachment means, not shown, for the fastening of the chair on either the upper part of a toilet or the upper part of the base unit 4.

When the chair module 2 is fastened to the upper part of the base unit 4, and with the potty 10 attached, the potty and child's chair according to the invention functions like a conventional potty chair. With the potty 10 removed the seat hole cover 6 can instead be fastened to the chair so that seat hole 12 is covered, and the chair can function then as a child's chair of the armchair type. The support module 8 which includes upper attachment points 7 for attachment to the attachment points 5 on the chair module 2, as wall as a lower attachment point 9 for attachment to the attachment point 3 comprised in the chair module and/or the base unit 4, can be fastened to the child's chair and serve thereby as a front and crotch support. In this condition, the child's chair can, by means of said anchoring organ, be attached to a chair to form a child's high chair.

Figure 2:
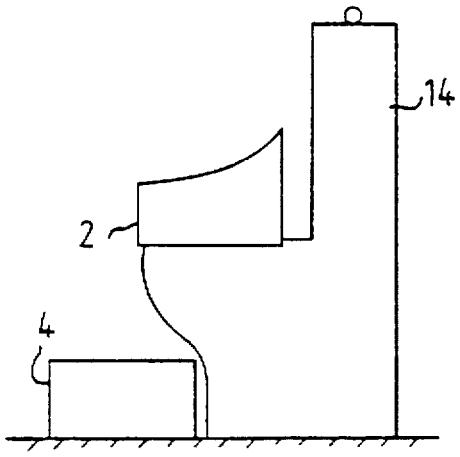
FIG. 2 shows a sides view of the child's chair in a combination together with a conventional toilet.

FIG. 2 shows in principle how the chair module 2 also can be fastened to the upper part of a conventional toilet 14 to adapt it to the child's size. The seat hole cover 6 can then be fastened to the upper part of the base unit 4 to make a footstool which can be used together with the chair nodule arranged on the toilet.

Figure 3:
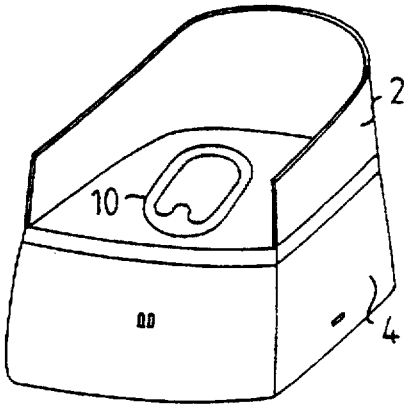
FIG. 3 shows in perspective the child's chair in a potty chair combination comprising the chair module, the base unit as well as a potty module.
Figure 4:
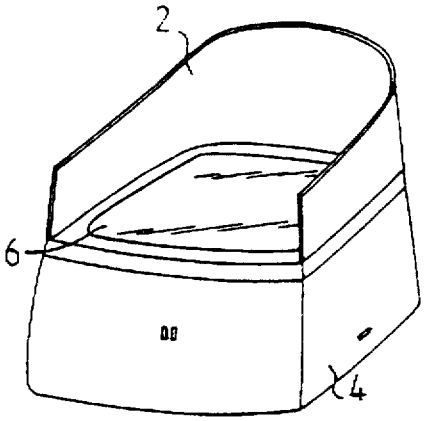
FIG. 4 shows in perspective the child's chair in a combination comprising a chair module, a base unit as well as seat hole cover constituting a sitting and standing surface.
Figure 5:
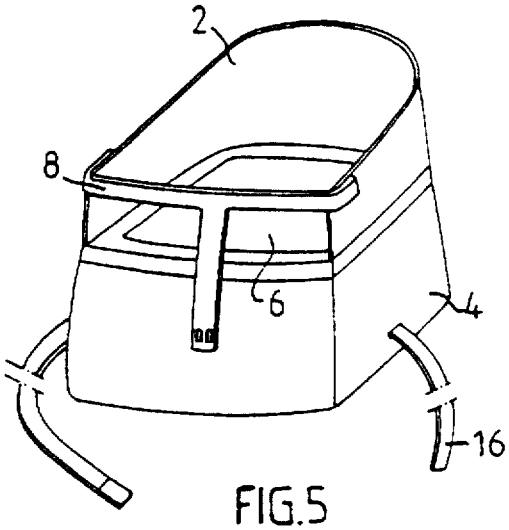
FIG. 5 shows the child's chair arranged to be used as a high child's chair with a front and crotch support.

FIG. 3 shows the chair module 2 fixed to base unit 4 and with potty 10 fitted in the seat hole. In this combination the modularly constructed child's chair 1 functions like a normal potty chair. FIG. 4 shows how said seat hole cover 6 is fitted to the chair instead of the potty 10 so that the seat hole is covered, and the chair 1 functions like a normal child's chair. In FIG. 5 not only seat hole cover 6 but also support module 8 is fitted to the chair. By means of anchoring organ 16, an anchoring belt in the embodiment shown in the figures, chair 1 can in this combination be attached to a normal chair to make a child's high chair. A not shown fastening belt, which can be elastic or inelastic, can be included in chair 1. In one embodiment the fastening belt is at one end permanently attached to the inside of the base unit and the other end attached to the anchoring belt or to some suitable part of the normal chair. In an embodiment the base unit alone can also be anchored on the normal chair. A special attachment point can be arranged for the fastening belts other end, to which attachment point the other end of the fastening belt can be fastened when chair 1 is not used as a child's high chair. The base unit 4 can, like the chair module, be equipped with rubber feet or a rubberised surface to prevent undesirable sliding.

Figure 6:
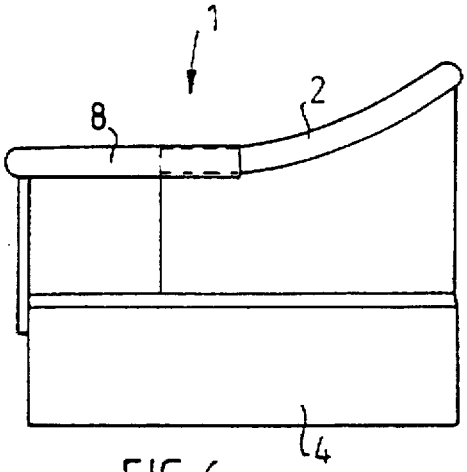
FIG. 6 shows a side view of the child's chair.

FIG. 6 shows in side view an embodiment of potty and the child's chair 1 with support module 8 attached. It can be seen in the figure that the support module 8 is fixed by an upper attachment point to the chair module's 2 side rest front part, and by a lower attachment point to the base unit 4. In another, not shown, embodiment, the chair module can have a base with an attachment point for the support modules 8 lower fastening means.

Figure 7:
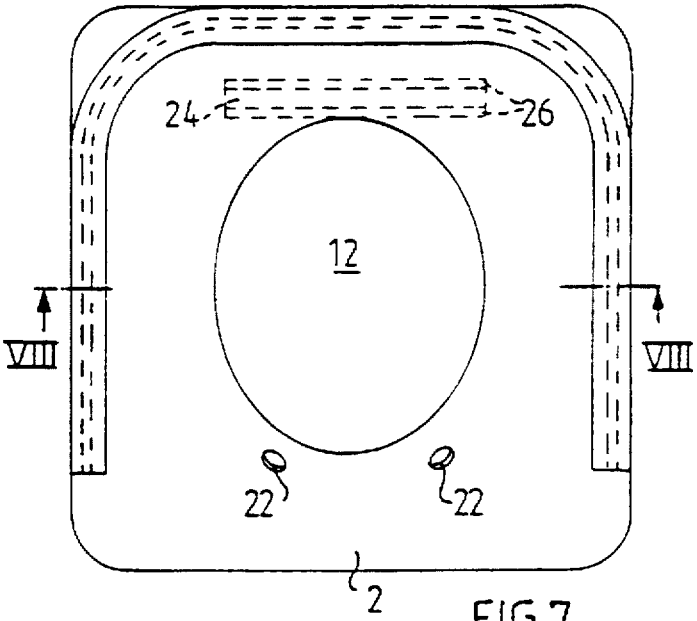
FIG. 7 shows a view from above of the child's chair.
Figure 8:
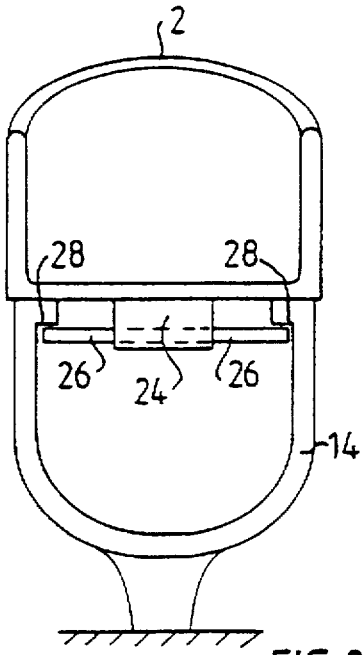
FIG. 8 shows a section through the child's chair fastened on a conventional toilet.
Figure 9:
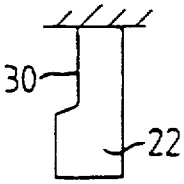
FIG. 9 shows in detail an opposing boss on the child's chair.

FIG. 7 shows an embodiment of the chair module 2 from above. Two opposing bosses 22 are placed in front of, and a locking device 24 comprising two sliding lock parts 26 is placed behind, the seat hole 12. When the chair module is to be fastened to a toilet the chair module is first placed so that opposing bosses 22 go against the front inner side of the bowl of the toilet. Then the two sliding lock parts 25 are slid out towards opposite sides of the inside of the toilet with a simple manipulation. FIG. 8 shows, in principle, a cross-section VIII from FIG. 7 of a chair module 2 fixed on a toilet 14. It is evident from the figure that the sliding lock parts go in under the edges 28 on the inside of the toilet 14. The chair module 2 is preferably so dimensioned and locking device 24 so positioned that slid parts 26 come to be slid out at the part of the toilet bowl which has the greatest width. When the sliding lock parts slide out, the chair module 2 is thereby slid forward so that the opposing bosses press against the front part of the inside of the toilets. Opposing bosses 22 have, in an embodiment shown in FIG. 9, a cut-in portion 30, so that the lower part of a boss inserted under a corresponding edge 28. In this way the chair module 2 is locked laterally and vertically. Tipping is prevented by these means through the sliding lock parts 26 and opposing bosses 22 being inserted under edges 28 in the above described way. Opposing bosses 22 and sliding lock parts can also be arranged so that the chair module can be locked to a conventional toilet seat in the lowered position, instead of on the porcelain as is shown in FIG. 8, but in the same way.

In a not shown embodiment of the invention the chair module is locked with fastening means which grip on the outside of the toilet. These fastening means can then for example be shaped like folding hooks which fold down over the edges on the outside of the toilet.

Figure 10A:
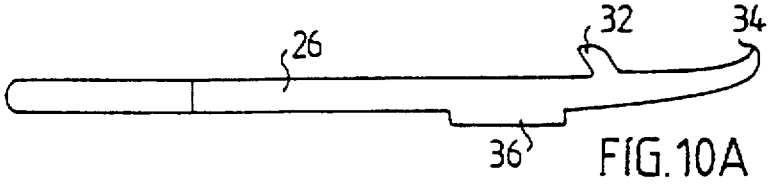
FIGS. 10A, 10B, 10C and 10D show an embodiment of a lock bolt from the locking means comprised in the child's chair.
Figure 10B:
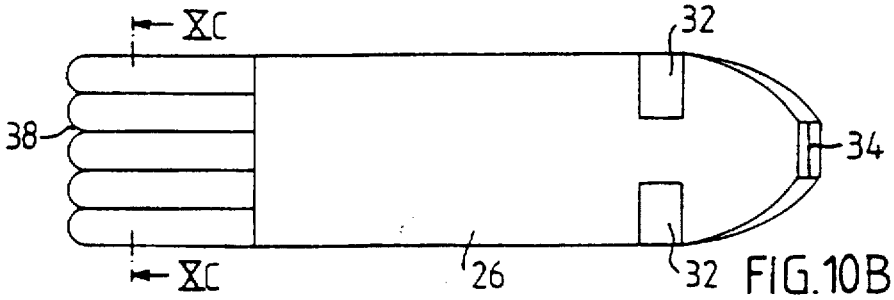
Figure 10C:
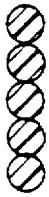
Figure 10D:
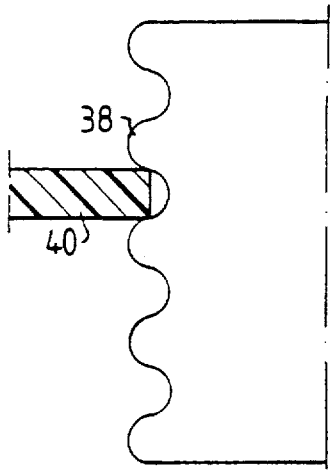

FIGS. 10A, 10B, 10C and 10D show an embodiment of sliding lock part 26 from the narrow side (10A), from the wide side (10B), in section (10C) and in detail (10D). Sliding lock part 26 is on the whole rectangularly shaped with a somewhat pointed, bent up first end 34 and wave-shaped second end 38. On a first side, near first, pointed end 34 are two lever arm bosses 32 which project in the same direction as pointed, bent up end 34. On the side opposite lever arm bosses 32, near the middle of the sliding lock part, is a raised thrust surface 36. The function of this part will be explained more closely with reference to FIGS. 12A and 12B. FIG. 10C shows a cross-section of wave-shaped end 38 and FIG. 10D shows in detail how the wave shape is used for shape conformal locking in the transverse direction on a toilet 40. Wave-shaped ends 38 can also have different lengths, so that an edge, for example a toilet, is fastened between a wave-shaped end 38 and the underside of the module on which the locking means are arranged.

Figure 11A:
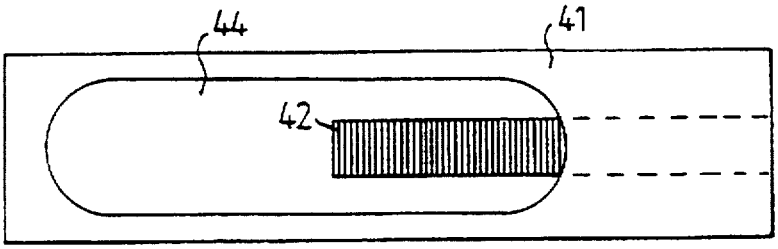
FIGS. 11A and 11B shows an embodiment of a housing of a looking means comprised in the child's chair.
Figure 11B:
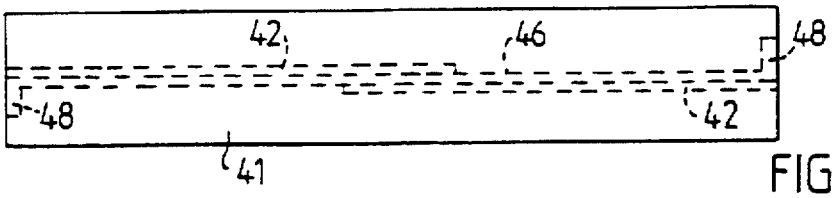
Figure 12A:
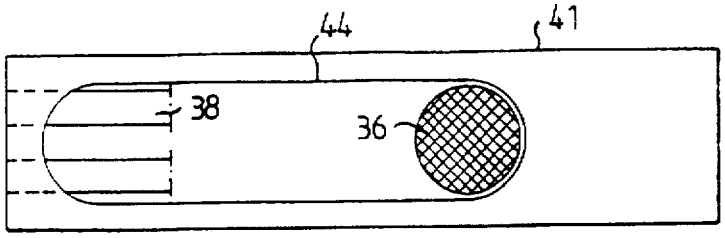
FIGS. 12A and 12B shows a locking means comprising the details according to FIGS. 10–11.
Figure 12B:
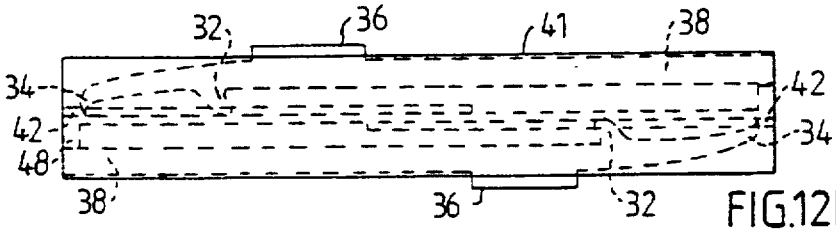

FIGS. 11A and 11B show in plan view, respectively side view, a housing 41 for said sliding lock parts. The housing 41 has in both side walls an elongate void 44 as well as a centrally placed inner longitudinal wall 46 with a shoulder 48 at each end. On both sides of the wall 46 is a ridged track 42. Housing 41 is open at each end. FIGS. 12A and 12B show in plan view, respectively side view, housing 41 into which two sliding lock parts 26 have been inserted. In the plan view it can be seen that thrust surface 36 sticks up out of the void 44. From FIG. 12B it can also be seen that the sliding lock parts are placed in the housing 41 on both sides of the inner wall 46 with lever arm bosses 32 turned towards inner wall 46. In the rest position bent up end 34 rests against the ridged track 42 with the point down in a valley on track 42, and slide part 26 is locked by these means against sliding in the longitudinal direction. When the thrust surface is pressed in, bent up end 34 is lifted out from ridged track 42 through a lever arm action with moment zero point at the tip of lever arm boss 32, and the slide part can be slid in the longitudinal direction. In the direction of wave-shaped end 38 slide part 26 is stopped when lever arm boss 32 comes up against shoulders 48 or when the thrust surface 36 comes up against one end of void 44. In the other direction slide part 26 is stopped, as in the first case, when the thrust surface 36 comes up against the other end of void 44. To remove slide parts 26 from the housing 41, thrust surface 36 are pressed in so far, in the direction of bent up point 34 that they can pass the limiting end of void 44 and be displaced in the direction of said point 34. Slide parts 26 are inserted into the housing in a corresponding manner.

FIG. 12 C shows, drawn in perspective, a second embodiment of a sliding lock part 60 which fits in a second embodiment of a locking device. Sliding lock part 60 is equipped with a tongue 64 with a thrust surface 62 which is arranged by or makes up a first end of the tongue 64. Tongue 64 is fixed at a second end 66 to sliding lock part 60 and is recessed in same so that there is a slot 68 between the tongues edge and sliding lock part 60. On the thrust surface 62 is also one or more projecting locking shoulders 69. The thrust surface 62 and locking shoulders 69 are arranged so that they can elastically be pushed in beyond an essentially flat side surface 70 on sliding lock part 60. An end 72 of sliding lock part 60 is provided with rounded terminations 74, with the same function as has been explained in connection with FIG. 10, which can be of different lengths and possibly with a groove 76 between them. In sliding lock parts upper part is also guide track 78 in the shape of a void or alternatively in the shape of a not shown rail.

FIGS. 12 D–12 G shows cross-sections of sliding lock part 60 take on lines A—A, B—B, C—C respectively D—D in FIG. 12 C.

FIG. 12 H shows in perspective view a lock housing 80, for said second embodiment of the locking device, arranged on a module part 82 for housing two sliding lock parts 60 of the type which have been explained in connection with FIGS. 12 C–G. Housing 80 is in profile essentially V-shaped or U-shaped and has in each side 82 an elongated cut-out 84. On a long side of cut-out 84 is a row of locking teeth 86 which are arranged so as to be able to receive the corresponding locking shoulders 69 on a sliding lock part 60. FIG. 12 K shows a lock housing 80 into which two sliding lock parts 60 are positioned mirror inverted facing each other. In the position shown, sliding lock part 60 are fully inserted into lock housing 80 and locking shoulders 69 are locked fast in the corresponding voids between the locking teeth 86 on the lock housing. If the thrust surface 62 with continuous locking shoulders 69 is now pressed in towards the centre of lock housings 80, locking shoulders 69 are freed and each sliding lock part can be slid in opposing directions with locking shoulders 69 running inside the row of locking teeth 86. When the thrust surface 62 is released it springs back and locking shoulders 69 are locked in another position, but in the same way, by locking teeth 86. Because of the projecting shape of thrust surfaces 62 sliding lock part are prevented from falling out of lock housing 80.

FIG. 12 J shows in profile a lock housing 80 arranged on a module part 82, with two sliding lock part 60 in the housing, and FIG. 12 I shows a housing cover 88 by means of which sliding lock parts 60 are locked in the housing. The housing is, as is shown in FIG. 12 J, arranged on a module part 82 so that it has an open first narrow side 91 by a corresponding void 93 with an attached recess on the module part. In an advantageous embodiment the lock housing 80 and the module part in question are made as one unit, which give manufacturing advantages as well as advantages in tooling, material etc.

On a second narrow side 89 opposite the open first narrow side 91, guide grooves 92 are arranged, possibly with an intermediately positioned longitudinal lower guide shoulder 90, by means of which the first longitudinal edges on sliding lock parts 60 are held fixed. When housing cover 88 (FIG. 12 I) is fixed on the void 93, sliding lock parts 60 are locked by guide rails 94 arranged on housing cover 88 which are arranged to fit into guide grooves 78. Housing cover 88 is also equipped with lock pins 96 which for example by means of a tolerance fit are received in corresponding holes 97 arranged in module part 82.

Figure 13A:
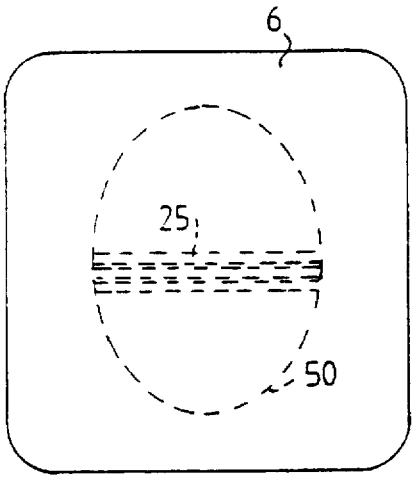
FIGS. 13A and 13B shows a seat hole cover comprising a locking means according to FIG. 12.
Figure 13B:
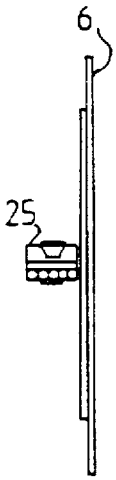

FIGS. 13A and 13B show in plan view, respectively side elevation, a seat hole cover 6 comprising a seat hole collar 50 corresponding to the shape of the seat hole 12, which can be completely or intermittently shaped, as well as a cover fastening means 25, which is preferably of the same type as chair locking device 24 on chair module 2.

Figure 14A:
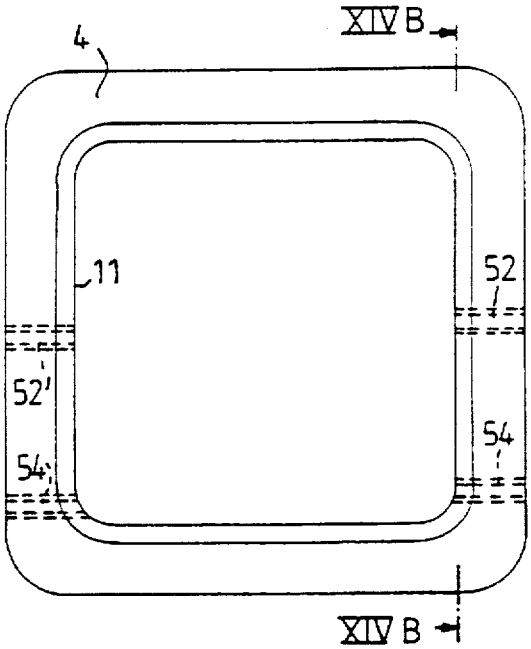
FIG. 14A shows in plan view a base unit.
Figure 14B:
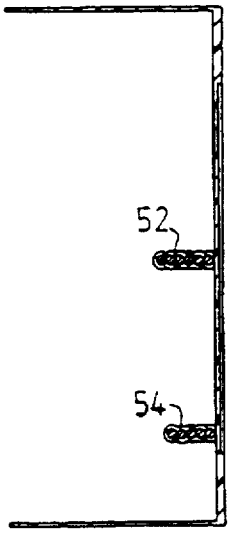
FIG. 14 B shows a section of the base unit according to FIG. 14A.
Figure 12C:
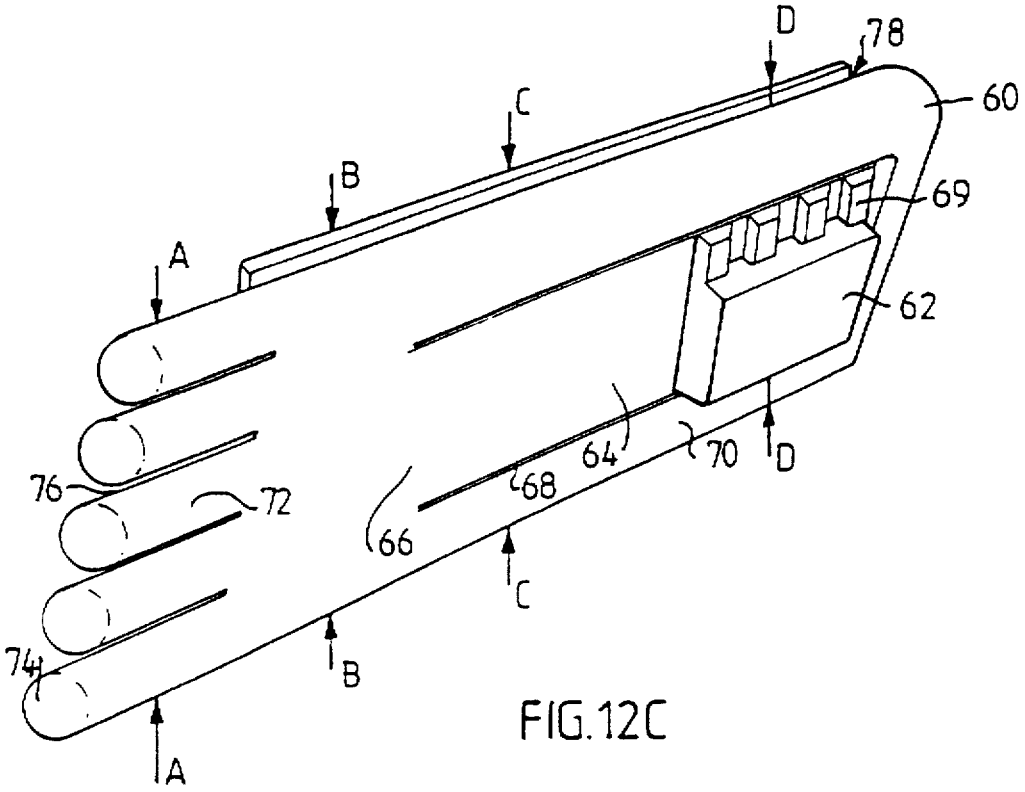
FIGS. 12 C–12 K shows details comprised in a second embodiment of a locking means for the anchoring of the modules to each other or to an existing chair or toilet.
Figures 12D, 12E, 12F, 12G:
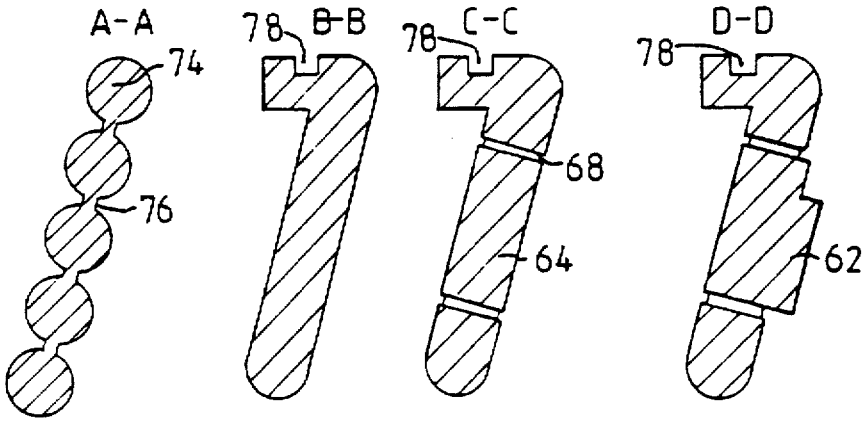
Figure 12H:
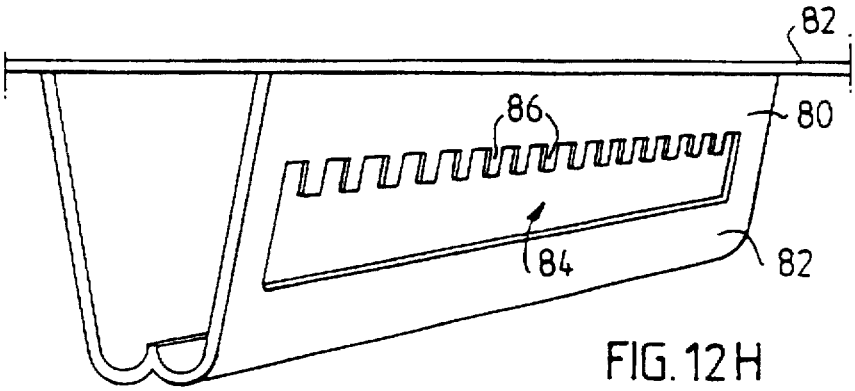
Figure 12I:
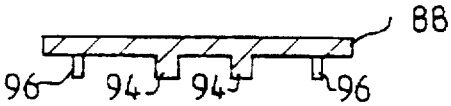
Figure 12J:
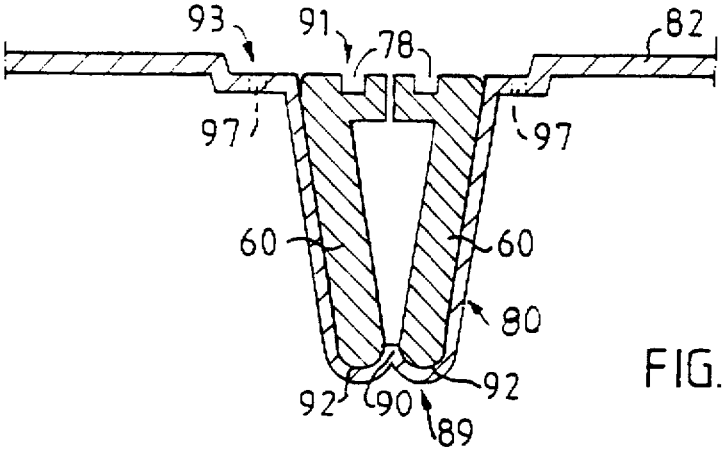
Figure 12K:
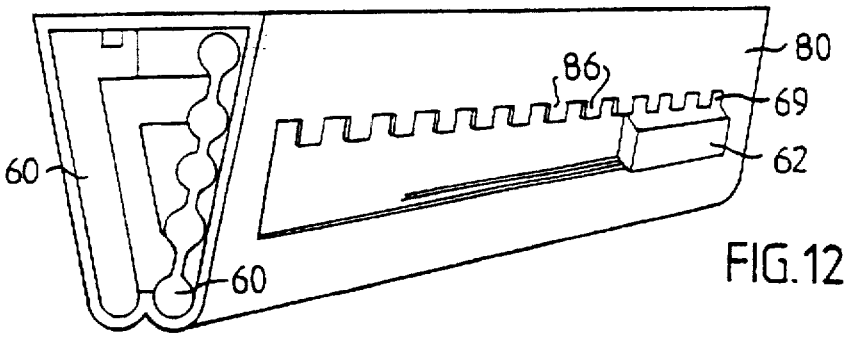

FIGS. 14A and 14B shows in side view, respectively section, an embodiment of the base unit 4. The base unit 4 has a void 11, is a cover lock receiver 52 and a chair lock receiver 54 for cover fastening means 25 respectively chair locking device 24. The base unit can also have a hard hole preferably in its rear edge. The section in FIG. 14B is taken on XIVB In FIG. 14A. In order that the seat hole cover shall be fastenable both directly on the base unit and with the mounted chair module, cover lock receiver 52 is equipped with at least one extra groove. The extra groove corresponds to the difference between the position of the cover lock in the two just mentioned mounting modes.

Figure 15:
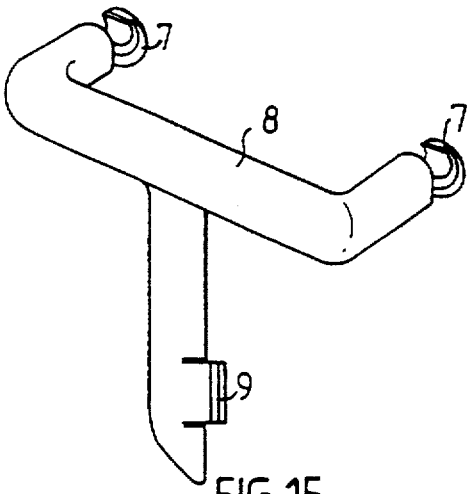
FIG. 15 shows a perspective view of a front and crotch support module.
Figure 16:
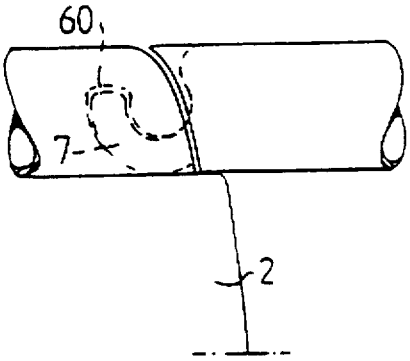
FIG. 16 shows in detail an embodiment of the fasting means for the attachment of the front and crotch support module on the chair module.
Figure 17A:
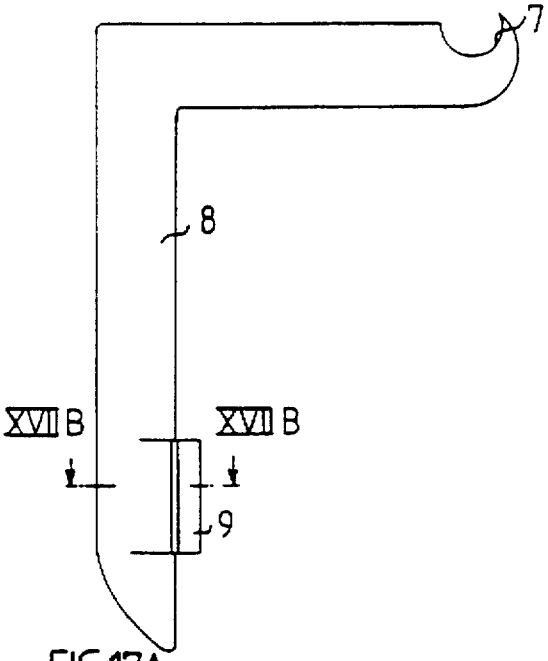
FIG. 17A shows in side elevation the front and crotch support module according to FIG. 15.
Figure 17B:
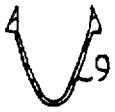
FIG. 17B shows in section an attachment organ for the attachment of the front and crotch support module on the base unit.

FIG. 15 shows in perspective an embodiment of the support nodule 8. The support module 8 has hooked chair fastening means 7, as well as a fastening means 9 which is able to be snap-fitted into slits in the base unit. FIG. 16 shows how such hooked chair fastening means are fitted into correspondingly shaped hooked recesses 60 in the border of the side wall in the chair module. FIG. 17A shows the support module 8 in side view and FIG. 17B shows a cross-section XVIIB of an embodiment of base unit fastening means 9, which is essentially U-shaped and equipped at the ends with lock hooks for hooking into said slits. When applying the support module 8 to potty and child's chair, the hooked chair fastening means 7 first enter into hooked recesses 60, and then fall downwards so that shape conformal locking occurs. Then base unit fastening means 9 are pressed together in a simple hand operation and introduced into the slits. When base unit fastening means 9 are then released the lock hooks bend out sideways and a shape conformal locking is achieved.

Figure 18:
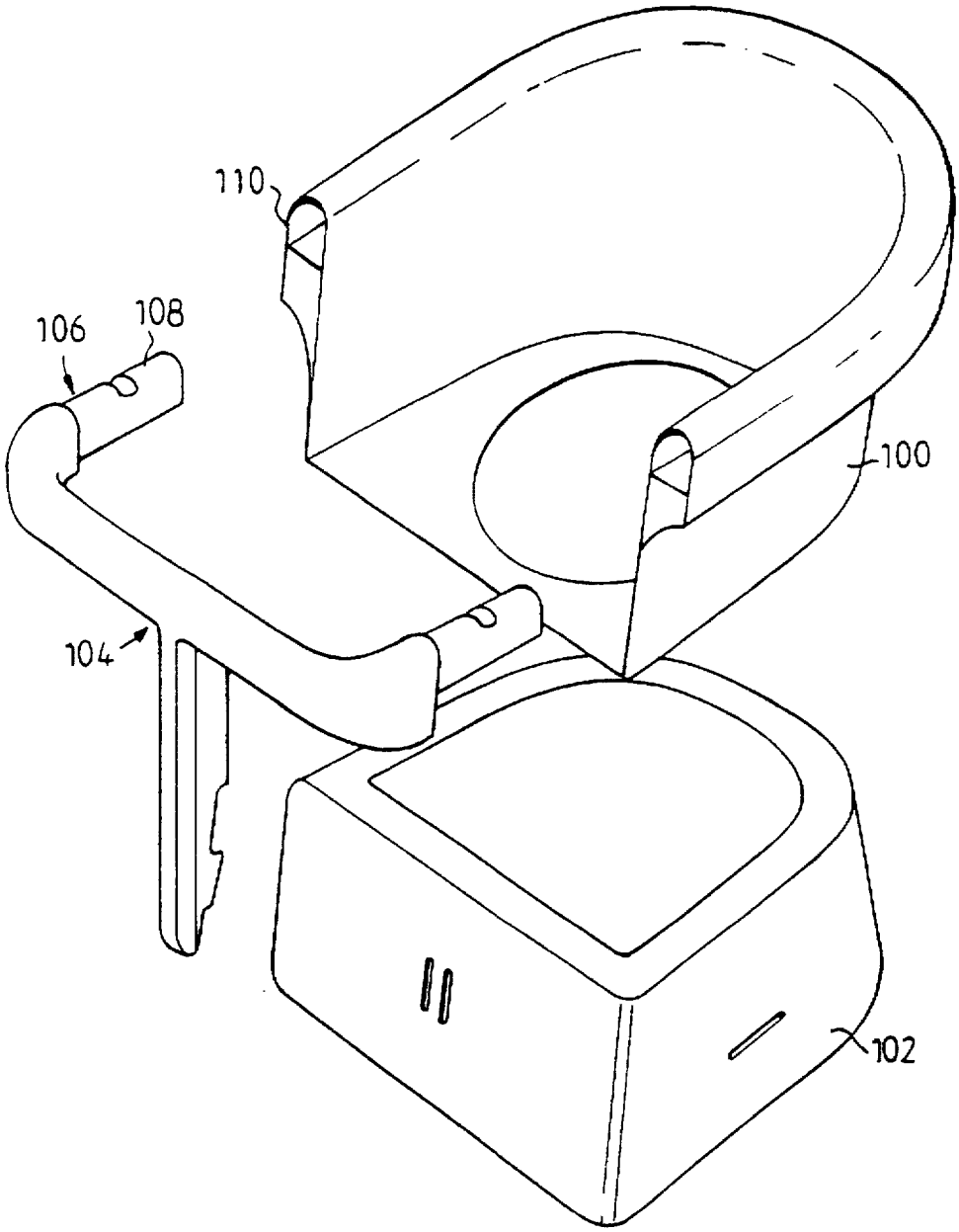
FIG. 18 shows an exploded view of an embodiment of a chair module, a base unit and a second embodiment of a front and crotch support module.

FIG. 18 shows, in an exploded view, an embodiment of a chair module 100, a base unit 102 and a second embodiment of a front and crotch support module 104. In the shown embodiment of front and crotch support module 104, chair fastening means 106 has a front edge 108 which is insertable in a correspondingly shaped hooked recess 110 in the chair module.

In a not shown embodiment the chair module and/or base unit include leg fastening organs for lockably attaching removable leg modules which belong to the modularly constructed child's chair. With the removable legs applied the modularly constructed child's chair can be used as a child's high chair, or the base unit as a taller stool. The leg fastening organ can, for example, be tubular details integrated with the chair module and/or the base unit at its or their four corners. The legs and the tubular leg fastening organs in that case preferably have corresponding profiles, for example, circular, square or rectangular. The locking itself of the legs to module in question can e.g. be made by means of known bayonet fitting, by means of pins or by another means.

The described embodiments of the details of the modularly constructed potty and child's chair are merely shown as examples. Other construction details are accommodated in the overall concept of the invention. Similarly the different module and constituent details can furthermore be combined differently, also in ways not shown, within the scope of the invention.

I claim:

1. Child's chair construction comprising a chair module with a backrest, a side rest and a seat equipped with a void for a seat hole into which a potty can be inserted, a base module which can be joined together with the chair module, and a removable seat hole cover which can be fastened over the seat, whereby the chair module is equipped with chair fastening means for joining together said chair module with the base module and whereby the base module is equipped with a receiver for the chair fastening means, wherein the chair fastening means comprises two opposing bosses arranged at the front part of the underside of the chair module and a locking device comprising two sliding lock parts arranged at the rear part of the underside of the chair module between the seat hole void and the backrest, said base module is shaped like a box with an essentially open first side and an opposing second side, including a void, the seat hole cover comprising cover fastening means for fastening the seat hole cover on either said chair module or said base module to make a footstool which can be used together with the chair module arranged on a conventional toilet.

2. Child's chair construction according to claim 1, wherein the base module comprises a first receiver for said cover fastening means and a second receiver for said chair fastening means.

3. Child's chair construction according to claim 1, further comprising a support module, serving as a front and crotch support, fastenable on each of the chair module and the base module.

4. Child's chair construction according to claim 1, wherein one of the chair module and the base module comprises anchoring means for anchoring of said one of the chair module and the base module to a conventional chair.

5. Child's chair construction according to claim 1, characterised in that it comprises leg modules which are removable and lockably fastenable to the chair module and the base module, whereby at least one of the chair module and the base module comprises leg fastening means for the removable and lockable attachment of said leg modules.

6. Child's chair construction according to claim 1, wherein the locking device comprises a slidable sliding lock part and an elongate lock housing, and wherein the sliding lock part comprises a thrust surface and first locking means, the lock housing is equipped with an elongate void and comprises second locking means cooperating with the first locking means.

* * * * *